US011105030B1

(12) United States Patent
Buck

(10) Patent No.: US 11,105,030 B1
(45) Date of Patent: Aug. 31, 2021

(54) BREAK AWAY NEEDLE BAR STUD

(71) Applicant: James Buck, Benbrook, TX (US)

(72) Inventor: James Buck, Benbrook, TX (US)

( * ) Notice: Subject to any disclaimer, the term of this patent is extended or adjusted under 35 U.S.C. 154(b) by 992 days.

(21) Appl. No.: 14/804,118

(22) Filed: Jul. 20, 2015

(51) Int. Cl.
*D05B 55/14* (2006.01)

(52) U.S. Cl.
CPC ..... *D05B 55/14* (2013.01)

(58) Field of Classification Search
CPC ..... D05B 55/00; D05B 55/02; D05B 55/04; D05B 55/10; D05B 55/14; D05B 55/16
See application file for complete search history.

(56) References Cited

U.S. PATENT DOCUMENTS 3,364,888 A * 1/1968 Sibley, Jr. ..... D05C 11/14 112/273
4,127,076 A * 11/1978 Johnson ..... D05B 3/02 112/221
4,452,157 A * 6/1984 Cantada ..... D05B 81/00 112/220
4,508,042 A * 4/1985 Bianchi ..... D05B 55/02 112/226
4,519,326 A * 5/1985 Green ..... D05C 15/20 112/80.45
4,637,329 A * 1/1987 Czelusniak, Jr. ..... D05C 15/20 112/80.41
2007/0107470 A1* 5/2007 Tajima ..... D05B 55/14 66/116

* cited by examiner

*Primary Examiner* — Nathan E Durham
(74) *Attorney, Agent, or Firm* — Dickinson Wright, PLLC; Michael E. Noe, Jr.

(57) ABSTRACT

A needle bar stud having a break away region to induce part failure in the needle bar stud and not in the reciprocating slide block in an embroidery machine. The improved needle bar stud with the break away region features a replaceable insert to allow quick and easy repair of the embroidery machine when a jam occurs and the needle bar stud is damaged.

14 Claims, 6 Drawing Sheets

BREAK AWAY NEEDLE BAR STUD

BACKGROUND

1. Field of the Invention

The present invention relates generally to embroidery machines with break away needle bar studs, and more specifically to a system and method for a needle bar stud having a break away region to improve the maintainability of embroidery machines.

2. Description of Related Art

Referring to FIG. 1 in the drawings, a perspective view of a prior art one-piece needle bar stud illustrated according to the present application. Needle bar stud 101 includes a clamp or clamping portion 105 and a stud 107 rigidly affixed to the clamping portion 105. Needle bar stud 101 is clamped onto a needle bar 111. The needle bar 111 moves up and down as the embroidery machine actuates the stud.

Needle bar stud 101 is driven by needle bar reciprocator to sew thread into a garment. Each head in an embroidery machine will contain several needle bars, one for each different colored thread. Current embroidery machines feature needle bar studs, such as needle bar stud 101, which are fabricated entirely from metal. Current embroidery machines feature a needle bar reciprocator which have flanges for moving the stud that are fabricated from plastic.

When the needle attached to the needle bar strikes a solid part of the embroidery machines, such as the frame, then the plastic needle bar reciprocator being the softer, will shear off. The head of the embroidery machine, with the sheared needle bar reciprocator, will be out of commission until the needle bar reciprocator is repaired. Repairing a sheared needle bar reciprocator is a time and labor intensive process due to the complex nature of the reciprocator and typically requires a technician to repair. This breakdown of the entire head results in a machine that has no output or significantly less output depending upon the number of heads the machine has. While there are many systems for needle bar studs well known in the art, considerable room for improvement remains.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein;

Figure 1:
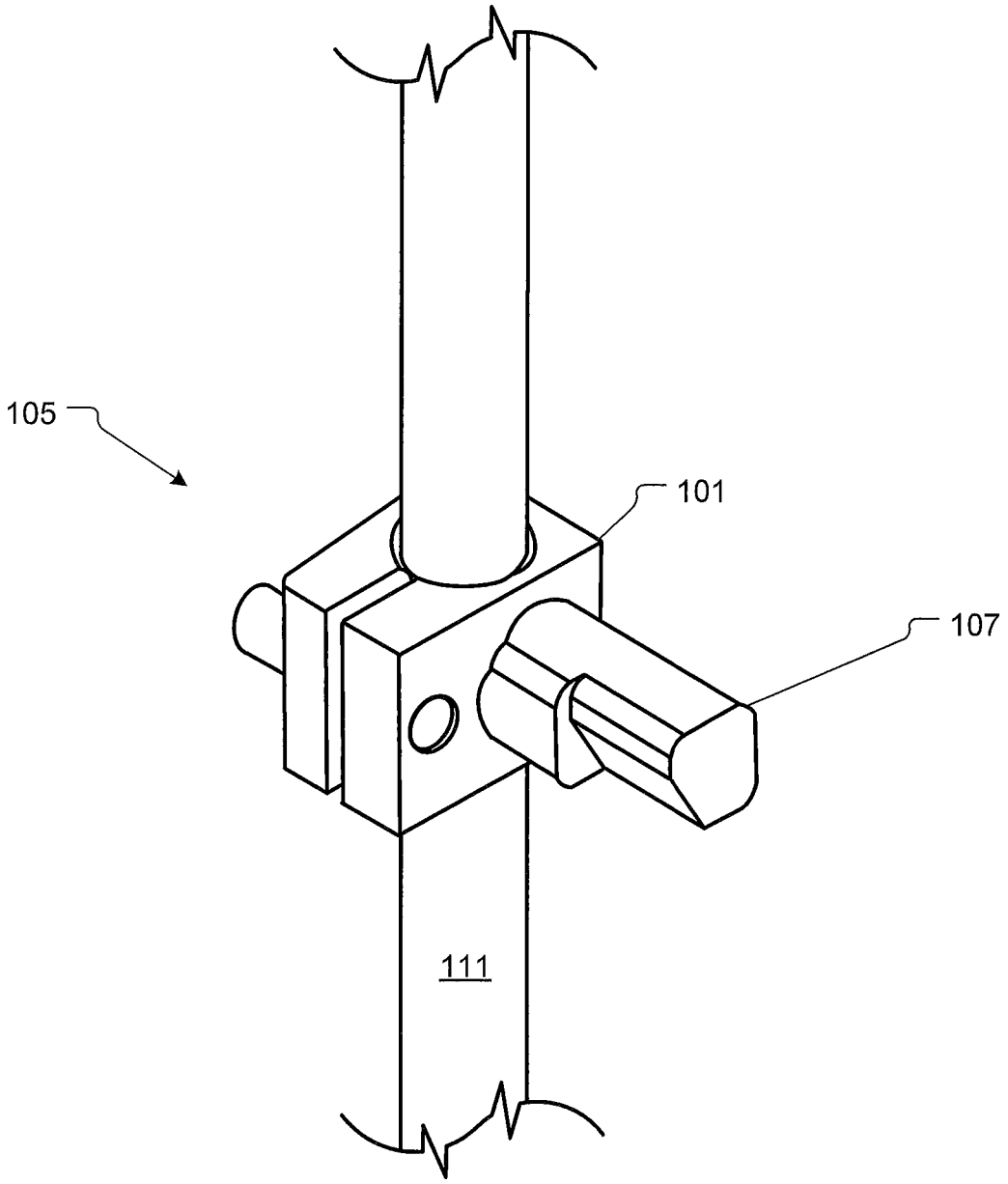
Fig. 1 Prior Art
FIG. 1 is a perspective view of a prior art one-piece needle bar stud illustrated according to the present application.

While the assembly of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the apparatus for a break away needle bar stud are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

A system is herein described that overcomes the limitations of the current systems for driving an embroidery needle. The system replaces the metallic stud with a plastic stud and replaces the plastic reciprocator with a metallic reciprocator. With this improved configuration when the needle strikes a solid part, such as the frame, the plastic stud is sheared instead of the reciprocator. Therefore, the user of the machine only has a single color of thread unusable due to the broken stud instead of a broken reciprocator. Additionally, the plastic stud is mounted to the needle bar by an easily removable sliding interface that allows a user to replace a broken stud easily by sliding out the broken bit and sliding in a new stud.

A reciprocator for driving a needle bar is a much more complicated part than a needle bar stud. Therefore, repairing and or replacing the needle bar stud is an easier, cheaper, and quicker repair than repairing and or replacing the reciprocator. Configuring the system to induce failures in the stud instead of the reciprocator increases the reliability of embroidery machine. Additionally, configuring the stud to have an easily replaceable insert further increase the reliability of the embroidery machine.

Figure 2:
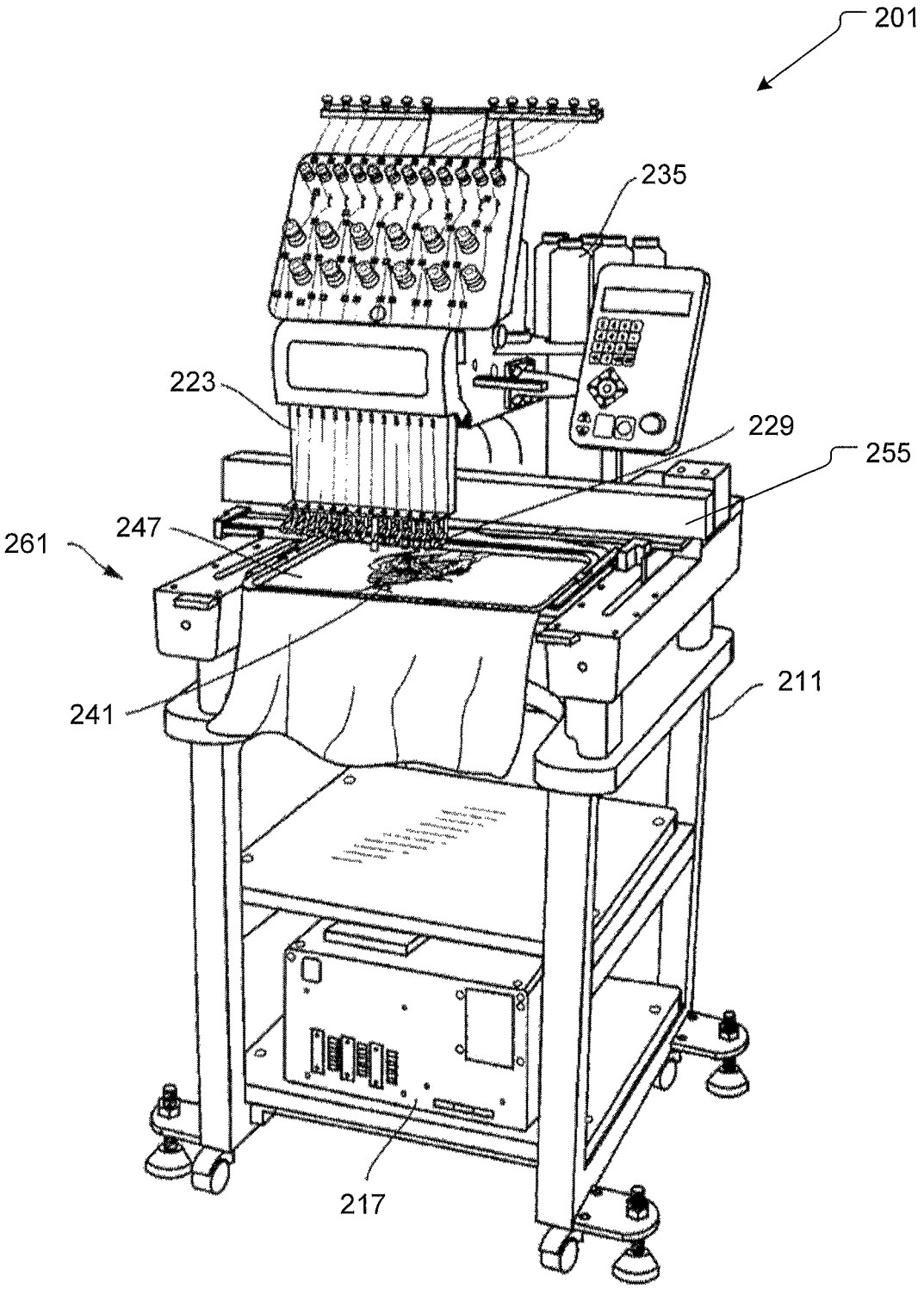
FIG. 2 is a perspective view of an embroidery machine with a break away needle bar stud illustrated according to the present application.

Referring now also to FIG. 2 in the drawings, a perspective view of an embroidery machine with a break away needle bar stud illustrated according to the present application. The automatic embroidery machine 201 has a chassis 211, a computer 217 mounted to the chassis 211, and at least one head 223 for performing embroidery functions on a workpiece. The head 223 has sewing needles 229 for sewing with different colors of thread 235 and stitching design 241 on the workpiece 247. A carriage assembly 255 is also mounted to the chassis 211 and is located adjacent to the head 223. The carriage assembly 255 is movable relative to the chassis 211 and the head 223 in response to commands from the computer 217 to move frame 261. Although automatic embroidery machine 201 is shown with only one head 223 and associated sets of components, it may utilize many more heads and components depending on the application.

Figure 3A:
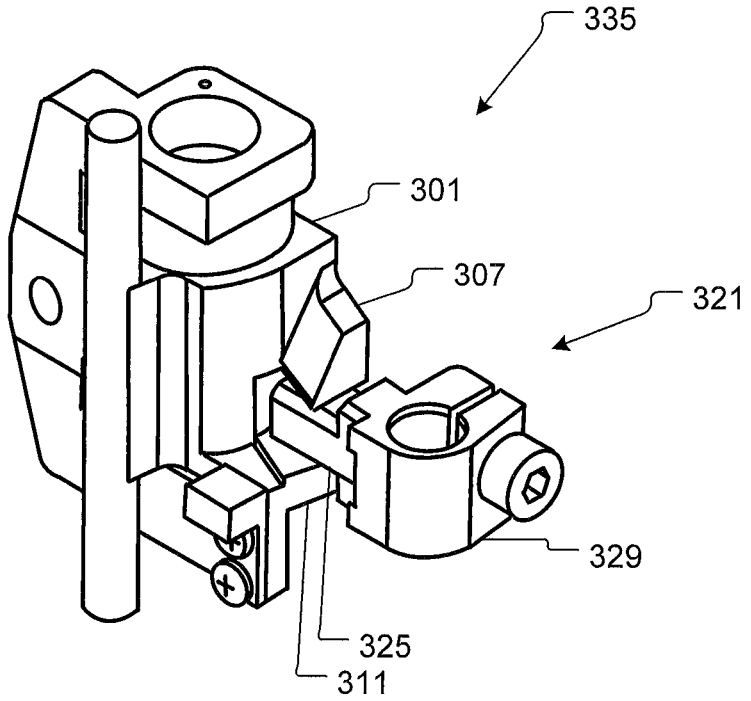
FIG. 3A is a perspective view of a needle bar reciprocator engaging a break away needle bar stud illustrated according to the present application.
Figure 3B:
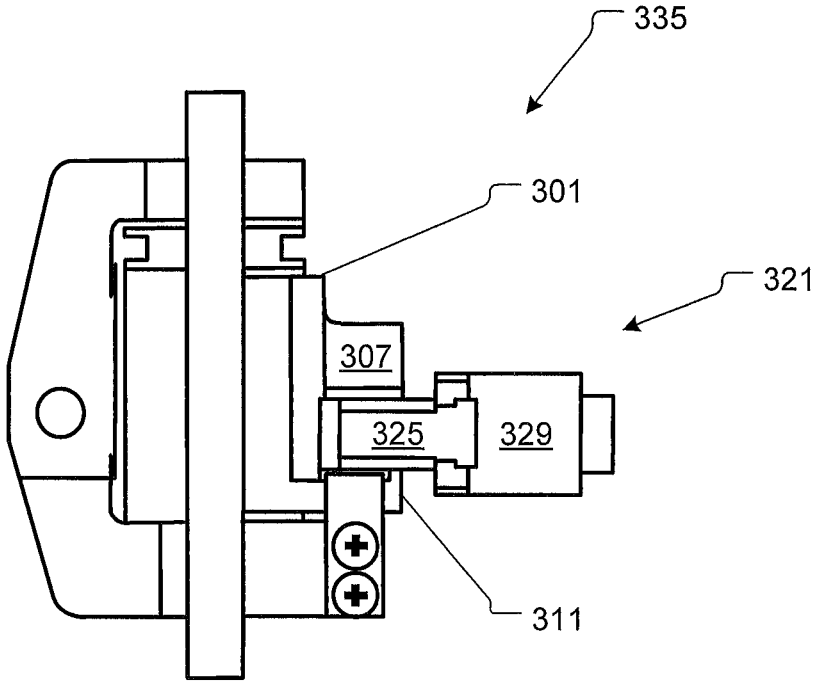
FIG. 3B is a side view of a needle bar reciprocator engaging a break away needle bar stud illustrated according to the present application.

Referring now also to FIG. 3A in the drawings, a perspective view of a needle bar reciprocator with a break away needle bar stud illustrated according to the present application. Referring now also to FIG. 3B in the drawings, a side view of a needle bar reciprocator with a break away needle bar stud illustrated according to the present application. Needle bar reciprocator 301 includes an upper flange 307 and a lower flange 311. Upper flange 307 is beveled. Needle bar reciprocator 301 is fabricated from a non-plastic material such as metal to increase the strength of the flanges that are configured to drive a needle bar stud and to reduce shearing in the needle bar reciprocator.

Needle bars are configured to be moved up and down to sew the thread into the article being embroidered. Needle bar reciprocator 301 engages the needle bar stud to drive the needle bar up and down. Needle bar reciprocator engages the needle bar stud by sliding along a line defined by the arrayed needle bar studs. Engagement occurs when flanges of the needle bar reciprocator are above and below the needle bar stud to be actuated.

Needle bar stud 321 is comprised of a stud 325 coupled to holder 329. Holder 329 has a first tab and a second tab to slidingly secure the stud 325 to the holder 329. Stud 325 has a first groove and a second groove configured to be slid onto the holder 329. The first groove and the second groove on stud 325 are not as wide as the stud so the stud can only be coupled to the holder from a single direction. Break away needle bar system 335 is comprised of a needle bar reciprocator 301 and a needle bar stud 321.

Figure 4:
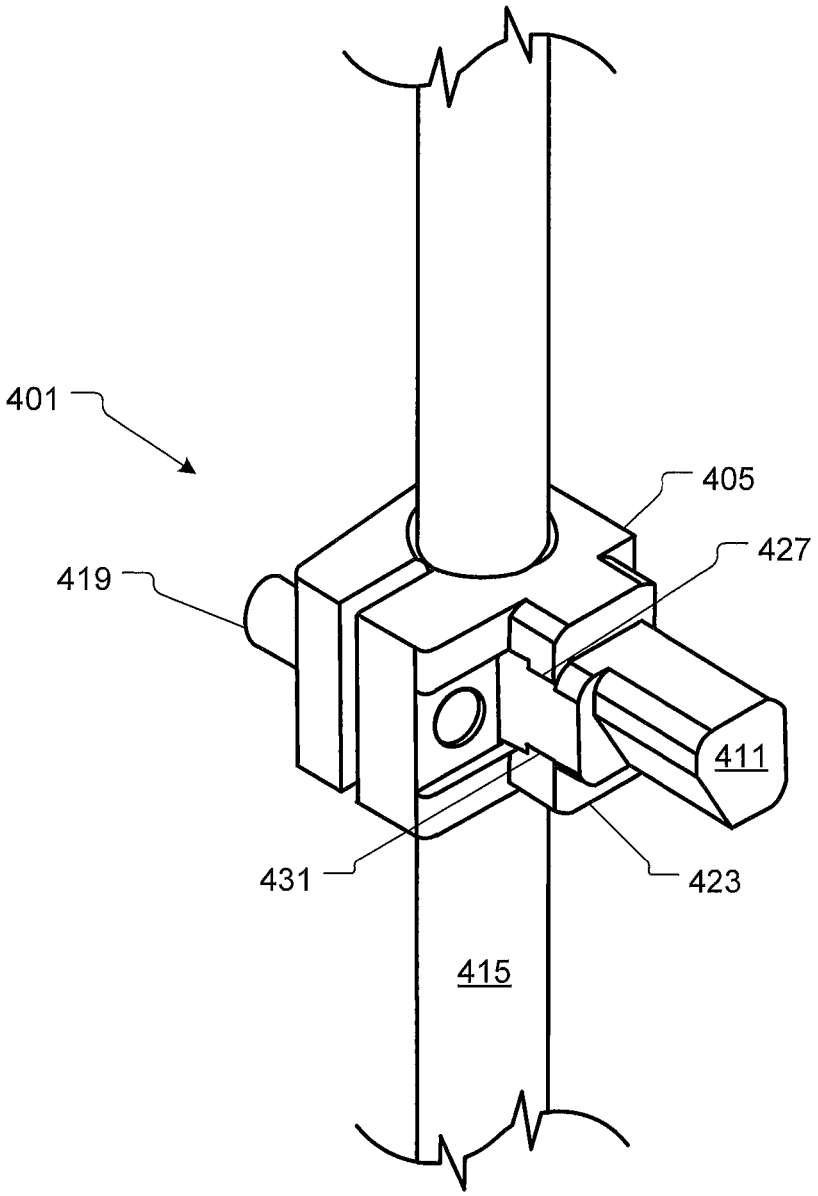
FIG. 4 is a perspective view of a needle bar stud holder engaging a replaceable break away stud illustrated according to the present application.

Referring now also to FIG. 4 in the drawings, a perspective view of a break away needle bar stud illustrated according to the present application. Needle bar stud 401 is comprised of a holder 405 and a stud 411. Holder 405 clamps to the needle bar 415 via a screw 419. A vertical position of holder 405 is adjustable by unclamping and sliding the holder up or down and reclamping. Holder 405 is preferably steel however other materials such as plastic are contemplated. Base 423 of holder 405 has a first tab 427 and a second tab 431. First tab 427 is held by first groove on the stud and second tab is held by second groove on the stud.

Stud 411 is held by holder 405 by sliding the stud onto the tabs of the holder. Stud 411 has a first groove and a second groove configured to be slid into the holder 405. The first groove and the second groove on stud 411 are not as wide as the stud so the stud can only be coupled to the holder from a single direction and prevent the stud from being installed upside down. The direction that the stud 411 slides into and out of the holder 405 is at a right angle or 90 degrees to the direction of the needle bar reciprocator to prevent inadvertent removal of the stud 411. If the needle bar reciprocator moved in the same direction as the engagement between the stud 411 and the holder 405, the stud would fall out over time.

Figure 5A:
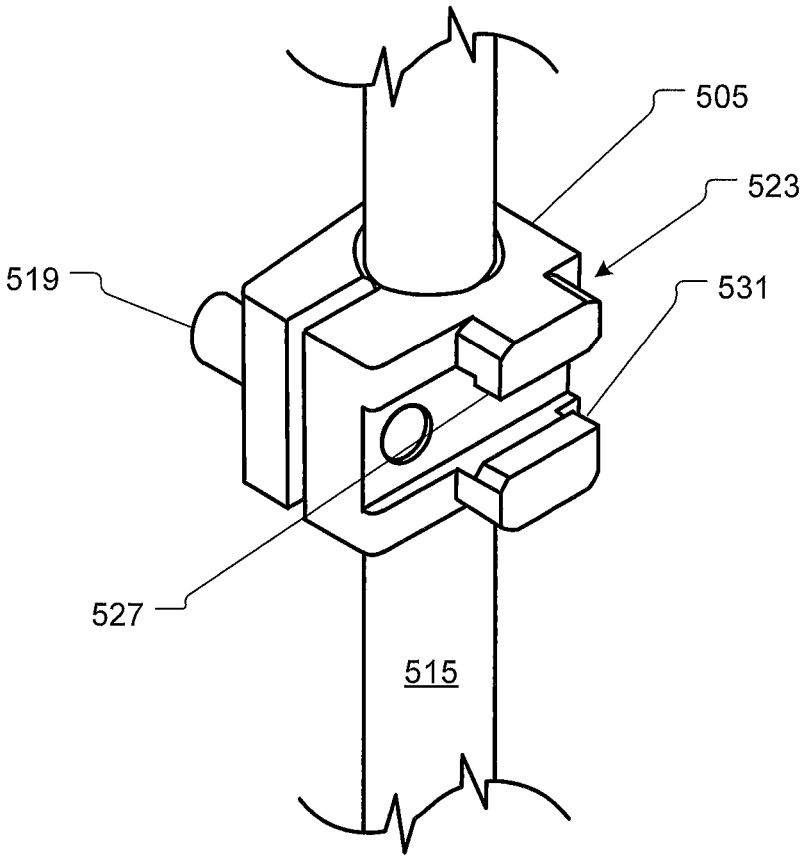
FIG. 5A is a perspective view of a needle bar stud holder illustrated according to the present application.

Referring now also to FIG. 5A in the drawings, a perspective view of a needle bar stud holder illustrated according to the present application. Holder 505 clamps to the needle bar 515 via a screw 519 in a clamp. A vertical position of holder 505 is adjustable by unclamping and sliding the holder up or down and reclamping as required. Holder 505 is preferably steel however other materials such as plastic or resin are contemplated. The base 523 of holder 505 has at least a first tab 527 and preferably a second tab 531.

Figure 5B:
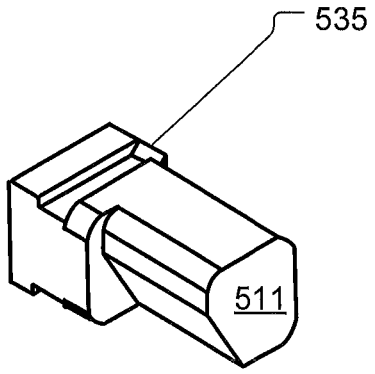
FIG. 5B is a perspective view of a replaceable break away stud illustrated according to the present application.

Referring now also to FIG. 5B in the drawings, a perspective view of a needle bar stud illustrated according to the present application. Stud 511 is secured to holder 505 by sliding the grooves of the stud onto the tabs of the holder. Stud 511 has a first groove and a second groove configured to be slid into the holder 505. The first groove and the second groove on stud 511 end in stops 535. Stops 535 prevent the stud from being installed upside down. Stops 535 are created by the first groove and the second groove having a length less than a length of the stud. The direction that the stud 511 slides into and out of the holder 505 is at a right angle or 90 degrees to the direction of the needle bar reciprocator to prevent inadvertent removal of the stud 511. If the needle bar reciprocator moved in the same direction as the engagement between the stud 511 and the holder 505, the stud would fall out over time. Stud 511 is preferably fabricated from a material that will shear, such as plastic, before the holder 505 or the needle bar reciprocator 301 shears from the needle striking a solid piece of the embroidery machine.

Figure 6:
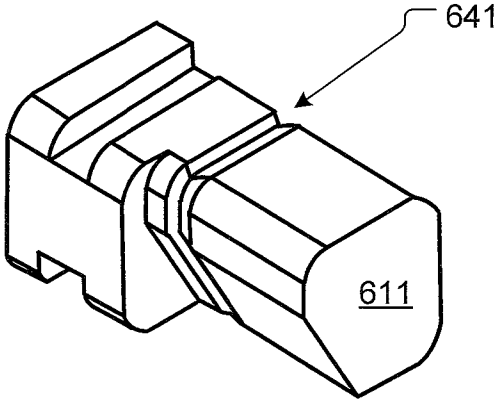
FIG. 6 is a perspective view of an alternative replaceable break away stud illustrated according to the present application.

Referring now also to FIG. 6 in the drawings, a perspective view of an alternative needle bar stud illustrated according to the present application. Stud 611 is secured to holder by sliding the stud onto the tabs of the holder. Stud 611 has a first groove and a second groove configured to be slid into the holder. An alternative stud uses grooves of different widths with a holder configured to secure the alternative stud. Grooves of different widths allow the stud to be installed in only one direction and prevent the stud from being installed upside down. The direction that the stud 611 slides into and out of the holder is at a right angle or 90 degrees to the direction of the needle bar reciprocator to prevent inadvertent removal of the stud 611. If the needle bar reciprocator moved in the same direction as the engagement between the stud 611 and the holder, the stud would fall out over time.

Stud 611 also features a region 641 that is selectively weakened in comparison the rest of the stud. Region 641 is configured to facilitate shearing in the region. Facilitation of shearing in the region 641 creates a known location for the stud to shear when the stud fails. The configuration for facilitating shearing can be accomplished by a variety of methods. The preferred method is to notch the stud such that a failure occurs when the strain in the stud is greater than the force of driving the needle into fabric. The notch in one embodiment is a channel located around the stud. Alternatively the channel is across only one section of the stud. Alternatively the stud is fabricated from two pieces, such as a first member and a second member, and adhesively attached together. The adhesive is selected to fail from the force of the needle striking a part of the machine such as the frame.

Increasing the reliability of an embroidery machine is possible by using elements of the system described above. Described herein is a method of using the break away needle bar stud. Providing an embroidery machine having a first plastic stud; a second plastic stud or replacement stud; and a needle bar reciprocator having metallic flanges. Embroidering a fabric by driving the first plastic stud up and down thereby driving the needle into the fabric. Removing a broken first stud when a jam occurs. Replacing the broken first stud with the second stud. Continuing to embroidery the fabric with the second stud. This quick and easy replacement reduces the downtime of the machine. Additionally providing a holder and sliding a replacement plastic stud into the holder makes the replacement of a sheared stud quicker and easier. Furthermore weakening the first plastic stud such that the first plastic stud shears before the metallic flanges of the needle bar reciprocator shear during a jam protects the needle bar reciprocator from a shearing failure that forces a user to lose use of a head of the embroidery machine with the failed needle bar reciprocator until the failed needle bar reciprocator is replaced.

With this system once a break away stud breaks a user removes the broken stud from the machine. The broken stud is removed by sliding the remaining piece of the broken stud from the base. Once the broken piece is removed a new stud is slid into place in the base or holder. Repairing a sheared or failed break away stud is a simple task that owner operators of the embroidery machine can accomplish themselves because of the ease of replacing the broken stud.

It is apparent that an assembly and method with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A break away needle bar system for an embroidery machine, comprising:

a needle bar stud assembly configured to engage a needle bar along an axis, the needle bar stud assembly comprises a stud and a holder coupled to the stud with a slide joint to slidingly secure the stud to the holder;

a needle bar reciprocator configured to engage the stud, the needle bar reciprocator comprises both an upper flange and a lower flange to capture and engage the stud; and the needle bar reciprocator is metallic and the stud is plastic, such that only the stud is configured to break if the needle bar strikes a solid part of the embroidery machine.

2. The system of claim 1, wherein the slide joint comprises grooves in the stud that receive respective tabs that extend from the holder.

3. The system of claim 2, wherein the grooves in the stud comprise a groove axial dimension that is less than a stud axial dimension of the stud, such that the stud can be coupled to the holder only from a single direction.

4. A needle bar stud assembly having a needle axis that is vertical, comprising:

a holder that is metallic and a stud that is plastic coupled to and extending horizontally from the holder in a radial direction relative to the needle axis, the holder is configured to clamp to a needle bar, a vertical position of the holder is configured to be adjustable along the needle bar, the holder comprises a base having tabs that define a horizontal slot between the tabs, the tabs are configured to engage respective grooves in the stud, and the grooves are configured to horizontally and slidably engage the respective tabs with the stud in the horizontal slot adjacent to a radial side of the needle bar relative to the needle axis.

5. The assembly of claim 4, wherein the grooves of the stud are narrower than the stud, such that the stud can be horizontally inserted into the holder from only one direction to prevent the stud from being installed incorrectly in the holder.

6. The assembly of claim 5, wherein an insertion direction of the stud into and out of the holder is horizontal relative to the needle axis to prevent inadvertent removal of the stud.

7. A needle bar assembly having a needle axis that is vertical, comprising:

a holder that is metallic and configured to clamp to a needle bar, a vertical position of holder is adjustable, the holder comprises a base having tabs that define a horizontal slot on a radial side of the needle bar relative to the needle axis; and a stud that is plastic and configured to horizontally engage the horizontal slot in the holder via slide grooves in the stud engaging the tabs of the holder, wherein the slide grooves in the stud comprise a mechanical stop, and the mechanical stop prevents the stud from being installed incorrectly in the holder.

8. The assembly of claim 7, wherein the stops comprises a stop length that is less than a stud length of the stud, and a direction that the stud slides into and out of the holder is horizontal relative to the needle axis to prevent inadvertent removal of the stud from the holder.

9. The assembly of claim 7, wherein the slide grooves of the stud have different widths to limit installation of the stud in the holder to only one direction.

10. The assembly of claim 7, wherein the stud comprises a weakened region that is structurally weaker than a remainder of the stud and configured to facilitate shearing in the weakened region.

11. The assembly of claim 10, wherein the weakened region comprises a notch in the stud, such that the stud is configured to break at the notch when a strain on the stud exceeds a force of driving a needle into fabric.

12. The assembly of claim 11, wherein the notch extends across only one section of the stud.

13. The assembly of claim 11, wherein the notch circumscribes an entirety of the stud.

14. The assembly of claim 11, wherein the stud comprises two pieces that are bonded together at the notch.

* * * * *